US007960675B2

(12) United States Patent
Grabmeier

(10) Patent No.: US 7,960,675 B2
(45) Date of Patent: Jun. 14, 2011

(54) UNMANNED MISSILE AND METHOD FOR DETERMINING THE POSITION OF AN UNMANNED MISSILE WHICH MAY BE UNCOUPLED FROM AN AIRCRAFT

(75) Inventor: Michael Grabmeier, Rosenheim (DE)

(73) Assignee: LFK-Lenkflugkoerpersysteme GmbH, Unterschleissheim (DE)

( * ) Notice: Subject to any disclaimer, the term of this patent is extended or adjusted under 35 U.S.C. 154(b) by 281 days.

(21) Appl. No.: 11/705,536

(22) Filed: Feb. 13, 2007

(65) Prior Publication Data

US 2008/0035785 A1 Feb. 14, 2008

(30) Foreign Application Priority Data

Feb. 16, 2006 (DE) ..... 10 2006 007 142

(51) Int. Cl.

| | |
|---|---|
| ***F41G 7/00*** | (2006.01) |
| ***F42B 15/01*** | (2006.01) |
| *F42B 15/00* | (2006.01) |
| *G06G 7/80* | (2006.01) |

(52) U.S. Cl. ..... 244/3.19; 244/3.1; 244/3.15; 701/200; 701/207; 701/213

(58) Field of Classification Search ..... 342/61–65, 342/175, 195, 357.01–357.17, 450–465, 342/352, 357.2–358; 244/3.1–3.3; 701/1–18, 701/200, 207–223; 343/705, 708; 89/1.11
See application file for complete search history.

(56) References Cited

U.S. PATENT DOCUMENTS

| | | | | |
|---|---|---|---|---|
| 2,964,266 | A * | 12/1960 | Fuchs | 244/3.11 |
| 2,998,942 | A * | 9/1961 | Kuck | 244/3.11 |
| 3,001,186 | A * | 9/1961 | Baltzer | 244/3.15 |
| 3,362,657 | A * | 1/1968 | McDaniel | 244/3.19 |
| 3,477,666 | A * | 11/1969 | Badessa et al. | 244/3.19 |
| 3,631,485 | A * | 12/1971 | Beazell, Jr. | 244/3.19 |
| 3,729,150 | A * | 4/1973 | Conger | 244/3.13 |
| 3,897,918 | A * | 8/1975 | Gulick et al. | 244/3.19 |
| 3,979,086 | A * | 9/1976 | MacAdam | 244/3.19 |
| 4,204,655 | A * | 5/1980 | Gulick et al. | 244/3.19 |
| 4,208,024 | A * | 6/1980 | Killpatrick et al. | 244/3.15 |
| 4,216,472 | A * | 8/1980 | Albanese | 244/3.19 |
| 4,256,275 | A * | 3/1981 | Flick et al. | 244/3.19 |
| 4,264,907 | A * | 4/1981 | Durand et al. | 244/3.15 |
| 4,350,983 | A * | 9/1982 | Blaha et al. | 244/3.19 |
| 4,494,121 | A * | 1/1985 | Walter et al. | 343/708 |
| 4,540,139 | A * | 9/1985 | Levy et al. | 244/3.19 |
| 5,064,141 | A * | 11/1991 | Nesline, Jr. | 244/3.15 |
| 5,232,182 | A * | 8/1993 | Hamilton | 244/3.19 |

(Continued)

FOREIGN PATENT DOCUMENTS

GB 2 403 789 A 1/2005

(Continued)

*Primary Examiner* — Bernarr E Gregory

(74) *Attorney, Agent, or Firm* — Crowell & Moring LLP

(57) ABSTRACT

An unmanned missile which may be uncoupled from a preferably propelled aircraft has a navigation and control device which has a receiver for position determination signals. The receiver is electrically connected to a first antenna, and receives signals collected by the first antenna and transmits same as position determination signals to the navigation and control device. The missile has an electrical signal input by which the missile is connected to the aircraft until it is uncoupled from the aircraft, and by which the missile is supplied with signals for position determination. The missile is provided with at least one additional antenna which is also electrically connected to the receiver.

10 Claims, 2 Drawing Sheets

U.S. PATENT DOCUMENTS 5,451,014 A * 9/1995 Dare et al. ..... 244/3.15
5,613,650 A * 3/1997 Kaifu et al. ..... 244/3.16
5,657,947 A * 8/1997 Mayersak ..... 244/3.19
5,671,138 A * 9/1997 Bessacini et al. ..... 244/3.13
5,671,139 A * 9/1997 Bessacini et al. ..... 244/3.13
5,671,140 A * 9/1997 Bessacini et al. ..... 244/3.13
5,847,675 A * 12/1998 Poinsard ..... 244/3.19
5,938,148 A * 8/1999 Orenstein ..... 244/3.15
5,943,008 A * 8/1999 Van Dusseldorp ..... 701/213
5,943,009 A 8/1999 Abbott
5,944,762 A * 8/1999 Bessacini et al. ..... 244/3.13
5,987,362 A * 11/1999 Bessacini et al. ..... 701/1
6,161,061 A * 12/2000 Bessacini et al. ..... 701/1
6,349,898 B1 * 2/2002 Leonard et al. ..... 244/3.15
6,520,448 B1 * 2/2003 Doty et al. ..... 244/3.23
6,755,373 B1 * 6/2004 Moore ..... 244/3.17
6,779,752 B1 * 8/2004 Ratkovic ..... 244/3.15
6,806,823 B1 * 10/2004 Smith et al. ..... 342/62
6,883,747 B2 * 4/2005 Ratkovic et al. ..... 244/3.15
2002/0174763 A1 11/2002 Shnaps
2004/0188561 A1 * 9/2004 Ratkovic et al. ..... 244/3.15

FOREIGN PATENT DOCUMENTS

WO WO 99/02936 1/1999

* cited by examiner

UNMANNED MISSILE AND METHOD FOR DETERMINING THE POSITION OF AN UNMANNED MISSILE WHICH MAY BE UNCOUPLED FROM AN AIRCRAFT

This application claims the priority of German patent document 10 2006 007 142.5-53, filed Feb. 16, 2006, the disclosure of which is expressly incorporated by reference herein.

The present invention relates to an unmanned missile, and to a method for determining the position of an unmanned missile which may be uncoupled from an aircraft.

BACKGROUND OF THE INVENTION

Unmanned missiles are generally known, for example in the military sector as reconnaissance missiles or guided missiles. One problem with such unmanned missiles is ensuring the navigational accuracy of the missile immediately after it is uncoupled from the aircraft, and in its subsequent independent flight. As long as the missile is mounted on or in the aircraft, it is shielded by the aircraft, so that the reception of position determination signals (for example signals from satellites for a navigation system such as GPS or Galileo) by the receivers provided in the missile via the antenna attached to the missile is difficult, if not impossible. Thus, the receiver in the missile is unable to receive position determination signals via the missile-side antenna, or determine its own position, until the missile has achieved a certain distance from the aircraft, after uncoupling. The described time delay until the reception of the position determination signals by the missile receiver influences the strike accuracy of the missile immediately after uncoupling from the aircraft, as well as the accuracy of the missile reaching the target.

An unmanned missile disclosed in U.S. Pat. No. 5,866,838 has a navigation receiver which receives navigation signals via radio from the aircraft before the missile is uncoupled, by means of a repeater provided in the aircraft.

SUMMARY OF THE INVENTION

One object of the invention is to improve the navigational accuracy of a generic missile, immediately after its uncoupling from the aircraft and in its subsequent independent flight.

It is a further object of the invention to provide a method for determining the position of an unmanned missile which may be uncoupled from an aircraft, which allows a more accurate position determination.

These and other objects and advantages are achieved by the method and apparatus according to the invention, in which the missile is supplied with corresponding position determination signals from the aircraft during the carried flight when the missile is still coupled to the aircraft, so that the receiver for the missile receives signals for the position determination even before being uncoupled from the aircraft. The signals may be supplied continuously or during the carried flight, but may also be supplied until only just before the unmanned missile is uncoupled from the aircraft.

In this manner, at the time of uncoupling the missile from the aircraft there is already signal reception (via the aircraft-side antenna) by the receiver integrated into the missile, so that at the time of uncoupling the receiver is locked onto the navigation system and has a "lock-on" with the transmitters for the navigation system, such as the satellites. By switching the receiver over to the missile-side antenna at the time of uncoupling, this lock-on is not interrupted, so that after the uncoupling the receiver continuously receives further signals for position determination via the missile-side antenna.

As soon as these signals are autonomously received by the missile, the resulting position determination signals from the missile-side receiver are transmitted to the navigation and control device, so that it can then check the pre-planned flight path of the unmanned missile and, if necessary, institute corrective control measures. Since the missile is provided with at least one additional antenna which likewise is electrically connected to the receiver, this ensures that signals for position determination emitted by satellites are reliably received, both in the horizontal flight of the missile and in the subsequent vertical downward flight of the missile. For example, a first antenna is mounted in the rear of the missile and is optimally aligned for signal reception in vertical downward flight, and a second antenna is mounted in the region of the top side of the missile and is optimally aligned for signal reception in horizontal flight.

Thus, it is advantageous that the missile according to the invention is capable of navigation immediately after uncoupling from the aircraft and is maneuverable toward the target without waiting until it has moved beyond the reception shadow of the aircraft and the missile-side receiver has correspondingly received signals for the position determination. The maneuverability of the unmanned missile according to the invention is thus greatly improved. The provision of the two differently aligned antennas in the missile ensures that reliable reception of the signals for position determination emitted by satellites is always possible, regardless of the particular flight attitude of the missile, since in both vertical as well as horizontal flight one antenna is always directed upward, i.e., in the direction of the satellites for the navigation system.

The electrical signal input for the missile preferably is electrically connected to the receiver for position determination signals for the missile, and the signals delivered by the aircraft to the electrical signal input for the missile are supplied by an aircraft-side antenna. In this advantageous embodiment the analogous antenna signal from the aircraft is relayed to the unmanned missile, which then correspondingly processes the signal in its receiver. Alternatively, the electrical signal input for the missile may be electrically connected to the navigation and control device for the missile, and the signals delivered by the aircraft to the electrical signal input for the missile are position determination signals. In this alternative embodiment, the missile-side receiver is bypassed during the carried flight, and the signals delivered by the aircraft-side receiver are supplied directly to the navigation and control device for the missile.

In another embodiment of the invention, the missile has a device for determining the flight attitude, and the receiver receives signals from the first antenna or from one of the additional antennas, depending on the flight attitude of the missile. This ability to switch the antennas permits selection of the optimal antenna for each particular flight attitude, relative to the satellites for the navigation system. In this manner, not only is the best antenna signal transmitted to the receiver, but at the same time only the antenna which is situated on the side facing away from the earth is used for reception, so that this antenna is also shielded by the missile from interfering radiation emanating from the earth.

In one particularly advantageous embodiment of the missile, the receiver is a multiple receiver, so that it is able to process signals for position determination from at least two different navigation systems, such as GPS signals and Galileo signals, which it receives via the antennas, and to relay these signals to the navigation and control device. This embodiment allows use of position determination data which originate from different navigation systems, and thus provides redundancy.

It is also advantageous for the navigation and control device to be designed in such a way that it compares the position determination signals from the different navigation systems (which are received and preprocessed in the receiver) to one another in a testing and comparison unit, mutually checks them for plausibility, and with evaluation of the position determination signals from different navigation systems performs a position determination. In this manner it is possible not only to achieve higher accuracy in the determination of the missile's own position, but also at the same time to mutually check the position data originating from the different navigation systems for plausibility, and thus to recognize a possibly malfunctioning navigation system so that the data originating from this malfunctioning navigation system can be excluded from further processing.

The missile preferably is a glide missile, but alternatively or additionally, it may have independent propulsion.

In the method according to the invention, until the missile is uncoupled from the aircraft, the receiver for position determination signals which is provided in the missile receives the signals of at least one aircraft-side antenna, for determining position. After the missile is uncoupled from the aircraft the receiver receives only the signals from at least one missile-side antenna. For this purpose, after the missile is uncoupled from the aircraft the receiver for the missile receives the signals for position determination in vertical flight from a first missile-side antenna, and in horizontal flight, from a second missile-side antenna. The first missile-side antenna preferably is provided at the rear of the missile, and the second missile-side antenna is provided on the top side, which is situated facing away from the earth in the horizontal flight of the missile.

Uncoupling of the missile from the aircraft preferably is not enabled until the receiver for the missile receives signals for position determination via the aircraft-side antenna, and the navigation and control device for the missile has received the associated position determination signals from the receiver. This condition ensures that at the moment of uncoupling, the receiver provided in the missile has established reception contact with at least one satellite for the corresponding navigation system, so that after uncoupling, this contact to the missile-side antennas is not broken off during the switching of the antennas, thereby ensuring continuity of the position determination in the uncoupling phase of the missile from the aircraft.

Particularly advantageous is a method in which the receiver for the missile, designed as a multiple receiver, receives signals from at least two different navigation systems via the antennas and generates therefrom respective position determination signals which are relayed to the navigation and control device. The navigation and control device then compares the different position determination signals to one another and to a position determination result from a missile-side navigation system (such as an inertial system), and mutually checks same for plausibility. The navigation and control device performs a position determination based on the particular position data resulting from the position determination signals from the different navigation systems. This method provides for redundancy, since the instantaneous position of the missile can be determined on the basis of different navigation systems. If all navigation systems supply correct data, higher accuracy of the inherent position determination may be achieved by simultaneous use of the position determination signals from the different navigation systems. On the other hand, if one of the navigation systems malfunctions or selectively emits inaccurate or distorted position data, this can be recognized by a plausibility check, and the data from this navigation system can be excluded from the position determination.

Alternatively, until the missile is uncoupled from the aircraft, the navigation and control device for the missile may receive position determination signals from an aircraft-side receiver, and after the missile is uncoupled may receive position determination signals only from a missile-side receiver.

Other objects, advantages and novel features of the present invention will become apparent from the following detailed description of the invention when considered in conjunction with the accompanying drawings.

DETAILED DESCRIPTION OF PREFERRED EXEMPLARY EMBODIMENTS

Figure 1:
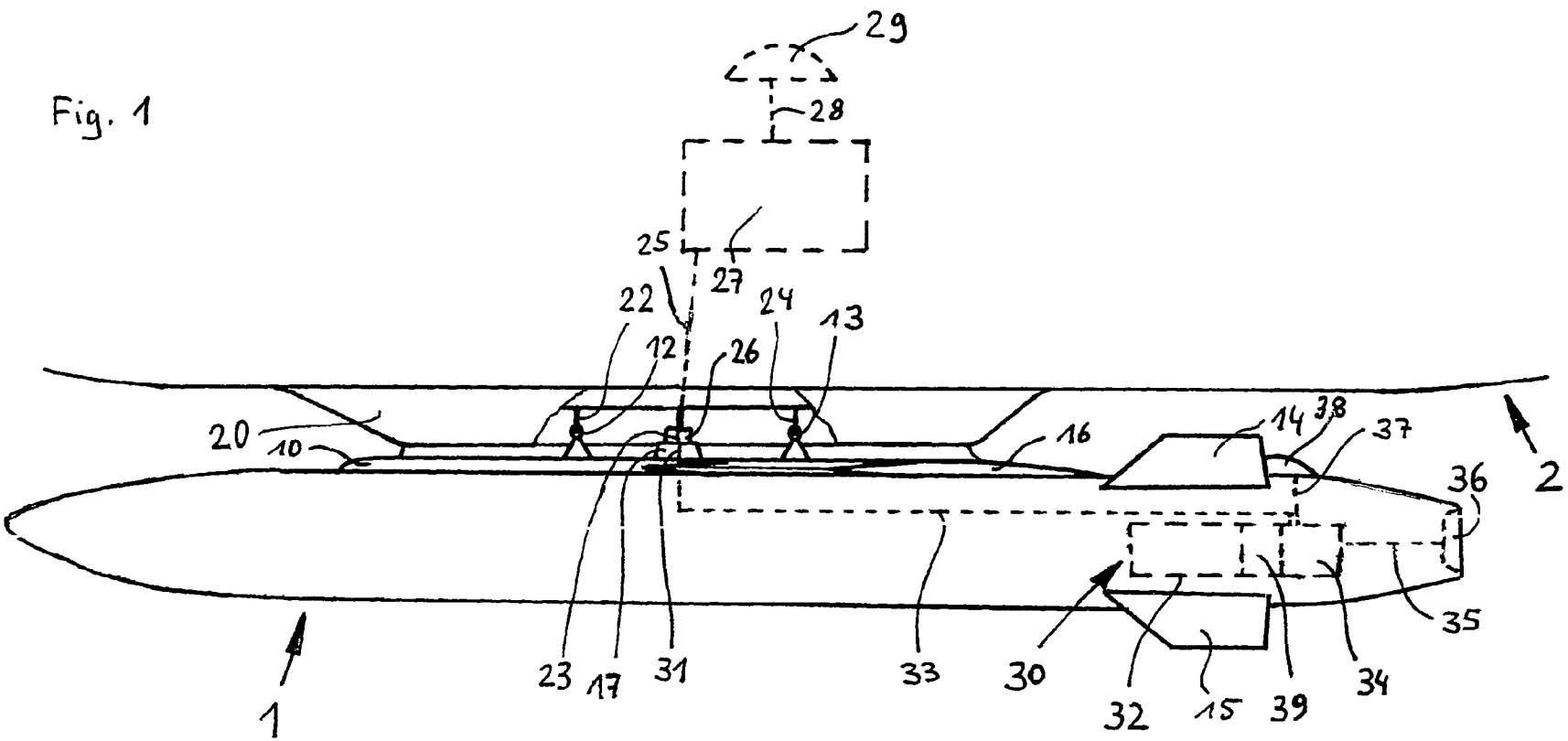
FIG. 1 is a schematic illustration of an unmanned missile coupled to an aircraft.

FIG. 1 shows an unmanned missile 1 which is coupled to a schematically illustrated aircraft 2. For this purpose, on the underside of the fuselage (or on the underside of a carrying surface), the aircraft 2 has a bomb pylon 20 which in FIG. 1 is shown in a partial sectional illustration. On its underside the bomb pylon 20 has a partly open design, and its interior has two detachable restraining devices 22, 24 which are engaged with two corresponding counter-restraining devices 12, 13 that project from an upper carrier element 10 for the missile 1 and fix the missile 1 to the aircraft 2. In the region of the open underside of the bomb pylon 20 an aircraft-side electrical plug-in connection 26 is provided which is mechanically and electrically connected to a mating connection 17 on the top side of the missile 1, the missile-side mating connection 17 having an electrical signal input 31.

As shown schematically in the figures, the missile 1 is provided with avionics 30. (Only a navigation and control device 32 having an integrated testing and comparison unit 39, a receiver 34 for position determination signals which is electrically connected to the navigation and control device 32, and antennas 36, 38 electrically connected to the receiver 34 are shown in the figures.)

At its rear section, the missile 1 is provided with preferably four control surfaces, of which only two, 14 and 15 are visible in the figure. The control surfaces are mutually spaced at uniform intervals over the periphery, able to swivel, and acted on by the navigation and control device 32. Two carrier surfaces 16 are mounted in the upper region of the missile to impart improved gliding properties to the missile 1.

The electrical signal input 31 for the missile 1 is connected to the navigation and control device 32 via a first signal line 33. A first missile-side antenna 36 is mounted in the rear of the missile and is connected to the missile-side receiver 34 via a second signal line 35. A second missile-side antenna 38 is mounted in the region of the top side of the missile and is connected to the missile-side receiver 34 via a third signal line 37.

The aircraft-side plug-in connection 26 contains a signal output 23 which is connected to a position signal receiver 27 for aircraft avionics, via a first aircraft-side signal line 25. The position signal receiver, in turn, receives position determination signals from an aircraft-side antenna 29 via a second aircraft-side signal line. In the example shown, the analog signal from the aircraft-side antenna 29 is transmitted by the position signal receiver and is present at the signal output 23.

During the carried flight, in which the missile 1, shown in FIG. 1, remains coupled to the aircraft 2, the receiver 34 for the avionics 30 of the carried missile 1 is supplied with position determination signals by the aircraft-side antenna 29 via the first missile-side data line 33, the plug-in connection 16, 26, and the first aircraft-side data line 25. The navigation and control device 32 is therefore supplied with position determination signals during the carried flight, and at all times is able to determine the instantaneous position of the aircraft 2 and of the missile 1 connected thereto.

During the carried flight, in which the unmanned missile 1 is still coupled to the aircraft 2, the receiver 34 for the missile 1 is initialized by the aircraft avionics via data lines 25, 33, whereby instantaneous data concerning position, velocity, and time as well as various other data relevant to navigation and communication are transmitted to the avionics 30 for the carried missile. The uncoupling mechanism for the unmanned missile 1 is not released until the aforementioned data have been transmitted to the missile 1, and the receiver 34 for the missile 1 has received corresponding position determination signals via the aircraft-side antenna 29 and thus established a connection to one or more satellites of a navigation system, so that the missile can be uncoupled from the aircraft 2 only after receipt of the aforementioned signals and establishment of a communication connection to at least one satellite of a navigation system.

Figure 2:
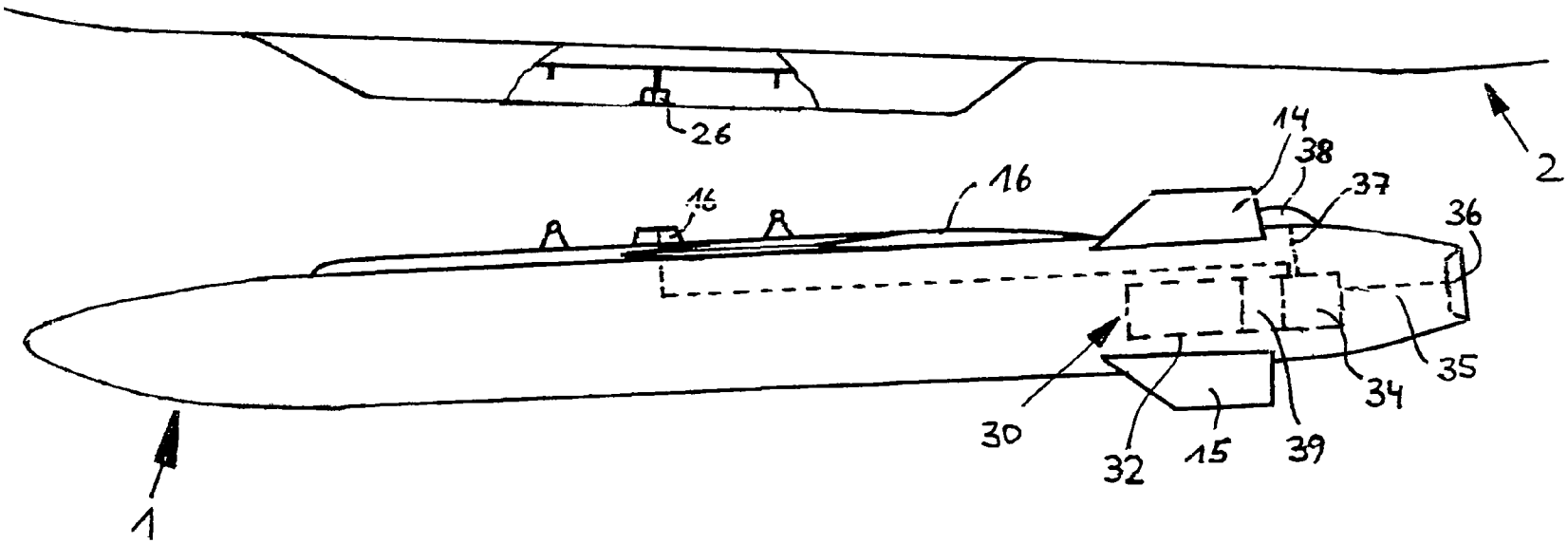
FIG. 2 is a schematic illustration of an unmanned missile uncoupled from the aircraft, immediately after the uncoupling.

When the unmanned missile 1 is uncoupled from the aircraft 2, as illustrated in FIG. 2, the plug-in connection 17, 26 is detached and the signal flow from the aircraft 2 to the missile 1 is interrupted. The position determined by the navigation and control device 32 for the missile 1 immediately before the signal flow is interrupted (based on the signals for position determination delivered by the aircraft) is stored in a memory (not shown) for the navigation and control device 32. Based on this stored position, the navigation and control device 32 determines the flight path to a predetermined target immediately after the missile 1 is uncoupled from the aircraft 2.

As soon as the missile 1 is free of the shadow of the aircraft 2 and has transitioned to vertical free-fall flight, the first missile-side antenna 36 provided in the rear of the missile 1 independently receives signals for the position determination. These signals are transmitted from the first antenna 36 via the second missile-side data line 35 to the missile-side receiver 34, which relays corresponding position determination signals to the navigation and control device 32, so that even in this free-fall flight phase the missile 1 is able to perform autonomous position determination.

When the missile 1 changes over to horizontal flight, the second missile-side antenna 38 provided on the top side of the missile 1 receives the signals for position determination and transmits these via the third missile-side signal line 37 to the missile-side receiver 34. The latter in turn relays the corresponding position determination signals to the navigation and control device 32. In this manner autonomous position determination may be carried out, even in the horizontal flight phase of the missile 1.

One special feature of the missile-side receiver 34 is that it may be a multiple receiver, for example a multiple frequency receiver, and is able to receive, either in alternation or simultaneously, signals from satellites for different navigation systems such as GPS and Galileo. These differing signals are then transmitted from the receiver 34 to the navigation and control device 32, which processes them in parallel or in alternation and subsequently compares the resulting position data to one another. Such a comparison is used for a plausibility check, by which recognition may be made as to whether one of the navigation systems is malfunctioning, or whether the data delivered by same are distorted.

If the signals from different navigation systems are classified as reliable in the testing and comparison unit 39 for the navigation and control device 32, on the basis of the signals from the multiple navigation systems the navigation and control device 32 is able to determine the position of the missile 1 itself more accurately than would be possible from use of signals from only a single navigation system.

If the unmanned missile 1 is designed as a weapon, as an example three different attack scenarios may be implemented:

a) For attacking a pre-planned stationary target, before the aircraft is started up the mission data such as the planned site for uncoupling the missile 1 from the aircraft 2, the target coordinates and other target parameters, approach parameters for the missile 1, and parameters for detonation of the weapon are Loaded in the avionics of the missile 1 or in a weapon transported thereby, and stored there;

b) For attacking a time-critical stationary target, after the aircraft 2 is started up the target to be attacked is determined by means of a target detection/target recognition system in the aircraft 2, and the corresponding target data are transmitted by the aircraft avionics to the avionics of the missile 1 or of the weapon transported thereby, and the mission planning, including the calculation for uncoupling, is performed by the avionics of the missile 1 or of the weapon transported thereby;

c) For attacking a time-critical movable target, the target is determined by a target detection/target recognition system in the aircraft 2, and the instantaneous target coordinates are transmitted from the aircraft 2 via radio data communication to the missile 1 which is then in independent flight, and the mission planning is then carried out in the avionics of the missile 1 or of the weapon transported by the missile 1 during the independent flight of the missile 1.

The invention is not limited to the above-described exemplary embodiment, which serves solely to illustrate in a general manner the essential concept of the invention. Rather, within the scope of protection the apparatus according to the invention, may encompass embodiments, other than those described above. In particular, the apparatus may have features which represent a combination of the respective individual features of the claims.

Reference numerals in the claims, the description, and the drawings are used solely for better understanding of the invention, and should not be construed so as to limit the scope of protection.

LIST OF REFERENCE NUMERALS

The reference numerals denote the following:

1 Missile
2 Aircraft
10 Carrier element

12 Counter-restraining device
13 Counter-restraining device
14 Control surface
15 Control surface
16 Carrier surface
17 Mating connection
20 Bomb pylon
22 Restraining device
24 Restraining device
25 First aircraft-side signal line
26 Plug-in connection
27 Aircraft-side receiver
28 Second aircraft-side signal line
29 Aircraft-side antenna
30 Avionics
31 Electrical signal input
32 Navigation and control device
33 First missile-side signal line
34 Receiver
35 Second missile-side signal line
36 First missile-side antenna
37 Third missile-side signal line
38 Second missile-side antenna
39 Testing and comparison unit

What is claimed is:

1. An unmanned missile which is configured to be uncoupled from an aircraft; wherein:

the missile has a navigation and control device that includes a receiver for position determination signals, and controls flight of the missile based on said position determination signals;

said receiver is electrically connected to a first antenna, which is mounted on board said missile, and collects said position determination signals;

said receiver receives said position determination signals collected by the first antenna;

the missile has an electrical signal input through which it is connected to the aircraft until it is uncoupled from the aircraft; and said aircraft has an antenna that also collects said position determination signals;

prior to uncoupling from the aircraft, the missile is supplied by the aircraft, via said electrical signal input, with said position determination signals collected by said antenna on board said aircraft, whereby, upon uncoupling of said missile from said aircraft said navigation system has a lock-on to said position determination signals received via the electrical signal input, which lock-on is not interrupted by uncoupling of said electrical signal input from said aircraft.

2. The unmanned missile according to claim 1, wherein:

said electrical signal input is electrically connected to said receiver; and said second position determination signals delivered by the aircraft via the electrical signal input are acquired via the antenna of the aircraft.

3. The unmanned missile according to claim 1, wherein:

the missile has at least one additional antenna that is also electrically connected to the receiver;

the missile has a device for determining flight attitude; and the receiver receives signals from the first antenna or from one of said at least one additional antenna, depending on the flight attitude of the missile.

4. The unmanned missile according to claim 1, wherein:

the missile has at least one additional antenna that is also electrically connected to the receiver;

the receiver is a multiple receiver;

the receiver is configured to process signals for position determination from at least two different navigation systems which it receives via the antennas, and to relay said signals to the navigation and control device.

5. The unmanned missile according to claim 1, wherein:

the missile comprises a glide missile and is provided with carrier surfaces.

6. The unmanned missile according to claim 1, wherein the missile has a propulsion unit.

7. An unmanned missile which is configured to be uncoupled from an aircraft; wherein:

the missile has a navigation and control device that includes a receiver for position determination signals;

said receiver is electrically connected to a first antenna, and receives position determination signals collected by the first antenna;

the missile has an electrical signal input through which it is connected to the aircraft until it is uncoupled from the aircraft;

the missile is supplied by the aircraft with signals for position determination, via the electrical signal input;

the missile has at least one additional antenna that is also electrically connected to the receiver;

the receiver is a multiple receiver;

the receiver is configured to process signals for position determination from at least two different navigation systems which it receives via the antennas, and to relay said signals to the navigation and control device;

the navigation and control device compares position determination signals from different navigation systems, which are received from the receiver, to one another in a testing and comparison unit, and mutually checks same for plausibility; and with evaluation of the position determination signals from different navigation systems, the navigation and control system performs a position determination.

8. A method for determining the position of an unmanned missile after being uncoupled from an aircraft, which missile is controlled by a navigation and control device based on position determination signals that are received via at least one antenna and are delivered by a receiver to the navigation and control device; wherein:

a position determination is performed on the basis of the delivered position determination signals;

prior to uncoupling of the missile from the aircraft, said receiver receives signals for position determination from an aircraft-side antenna;

after uncoupling, said receiver receives only signals from at least one missile-side antenna;

after uncoupling, the receiver for the missile receives the signals for position determination in vertical flight from a first missile-side antenna; and in horizontal flight, the receiver for the missile receives signals for position determination from a second missile-side antenna.

9. The method according to claim 8, wherein:

uncoupling of the missile from the aircraft is enabled only when said receiver has received signals for position determination via the aircraft-side antenna, and the navigation and control device for the missile has received associated position determination signals from the receiver.

10. The method according to claim 8, wherein:

said receiver is a multiple receiver and receives signals from at least two different navigation systems via the antennas, and generates therefrom respective position determination signals which are relayed to the navigation and control device;

the navigation and control device compares the position determination signals to one another and to a position determination result from a missile-side navigation system, and mutually checks for plausibility; and the navigation and control device performs a position determination based on position data resulting from the position determination signals from the different navigation systems.

* * * * *